United States Patent [19]

Mikulecky et al.

[11] 4,104,854

[45] Aug. 8, 1978

[54] DYNAMIC YARN-BRAKING ARRANGEMENT FOR AN OPEN-END SPINNING MACHINE

[75] Inventors: Karel Mikulecky, Chocen; Miloslav Tyl, Usti nad Orlici; Jan Janousek, Brandys nad Orlici; Frantisek Burysek, Usti nad Orlici; Stanislav Skoda, Usti nad Orlici; Stanislav Esner, Usti nad Orlici, all of Czechoslovakia

[73] Assignee: Vyzkumny ustav bavlnarsky, Usti nad Orlici, Czechoslovakia

[21] Appl. No.: 730,416

[22] Filed: Oct. 7, 1976

[30] Foreign Application Priority Data

Oct. 7, 1975 [CS] Czechoslovakia ..... 6778/75

[51] Int. Cl.[2] ..... D01H 15/00; D01H 13/16

[52] U.S. Cl. ..... 57/34 R; 57/58.95; 57/81

[58] Field of Search ..... 57/34 R, 78, 80, 81, 57/58.89–58.95

[56] References Cited

U.S. PATENT DOCUMENTS

| | | | |
|---|---|---|---|
| 3,354,626 | 11/1967 | Cizek et al. | 57/58.89 X |
| 3,354,631 | 11/1967 | Elias et al. | 57/58.95 |
| 3,462,936 | 8/1969 | Boucek et al. | 57/58.89 X |

*Primary Examiner*—John Petrakes

[57] ABSTRACT

An improved technique for stopping the advance of spun yarn through the draw-off rollers and distributing cylinder of an open-end spinning machine in response to a detected yarn breakage condition is described. A reversible clutch is selectively interposed between first and second oppositely rotating drive shafts and the cylinder, which in turn is coupled to the draw-off rollers. The clutch is operated from a normal forward advance condition to an operated reverse condition for a duration corresponding to a variable-duration control pulse generated in response to a yarn breakage condition upstream of the discharge end of the machine withdrawal tube. The duration of the control pulse is adjusted to dynamically brake the forward motion of the advancing yarn to a stop. The control pulse is removed soon enough to prevent reverse movement of the yarn.

2 Claims, 3 Drawing Figures

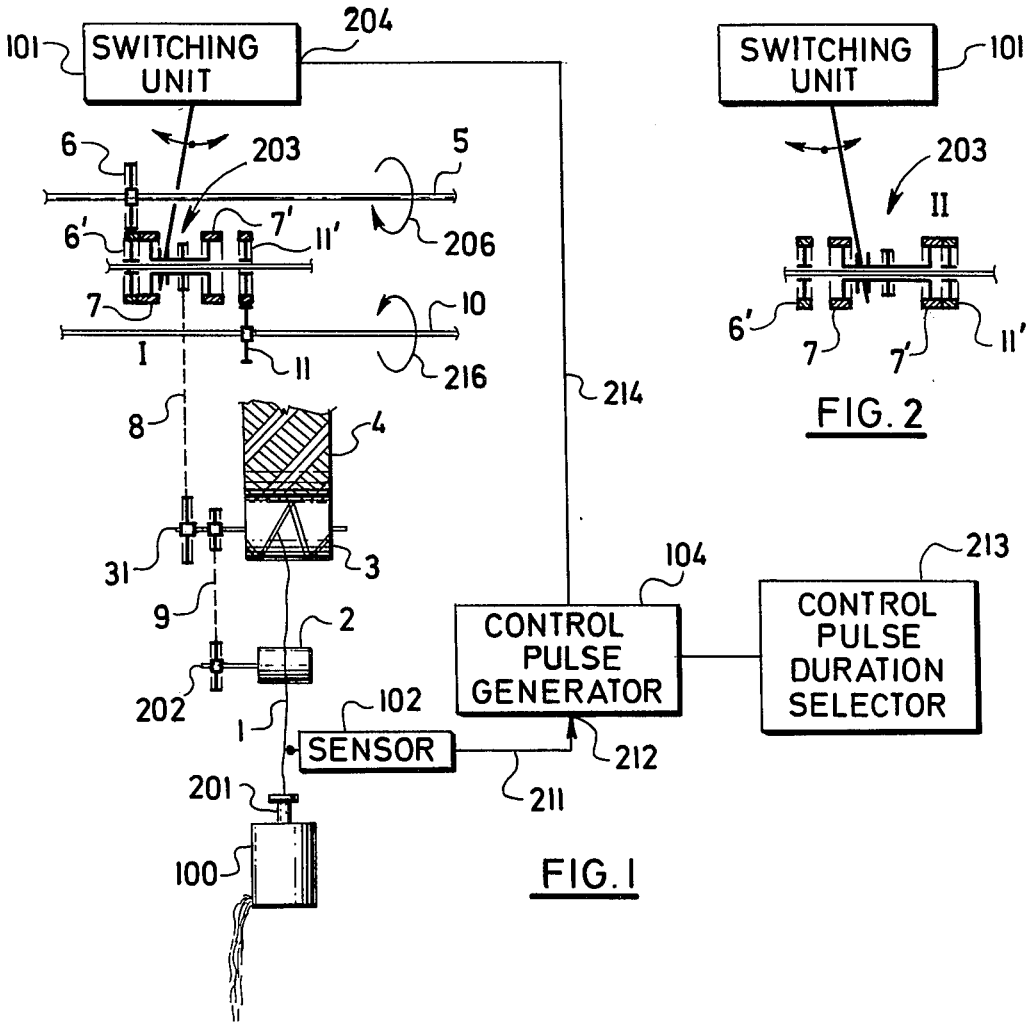
FIG. 2
FIG. 1
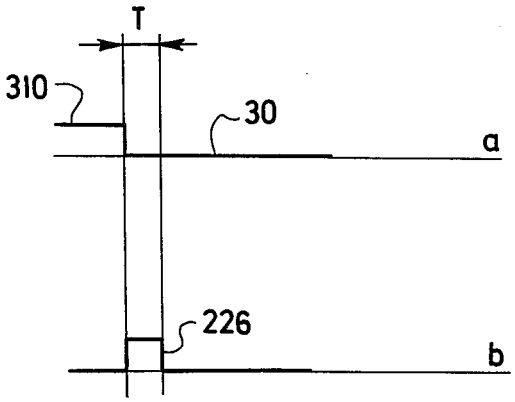
FIG. 3

DYNAMIC YARN-BRAKING ARRANGEMENT FOR AN OPEN-END SPINNING MACHINE

BACKGROUND OF THE INVENTION

The invention relates to open-end spinning machines, and more particularly to arrangements for stopping the advance of spun yarn through the outlet portion of the machine in response to a yarn breakage condition.

In the yarn-withdrawal portions of known open-end spinning machines, a pair of reversible draw-off rollers are disposed downstream of the spinning chamber for withdrawing spun yarn through a withdrawal tube at the output end of the chamber. The yarn advanced by the rollers enter distributing grooves on a traversing distributing cylinder, which is in frictional driving contact with a take-up bobbin. The rotation and traversing movement of the cylinder is effective to lay the spun yarn in a roving pattern on the periphery of the bobbin to define a yarn package. The drive for the cylinder, like that of the rollers, is made reversible, so that upon a suitable command associated, e.g., with a yarn breakage condition, the rollers and cylinder may be reversed to establish a conventional "spinning-in" condition whereby the yarn can be withdrawn into the spinning chamber through the withdrawal tube.

In such known systems, a finite interval is necessary between the detection of a yarn breakage condition and the initiation of a pre-set program for the application of reversing signals to the draw-off rollers and the distributing cylinders to start the spinning-in mode. During this finite interval, it is necessary to bring the yarn advance to a stop, to make sure that the broken yarn end does not exit from the distributing cylinder. Up to now, the stopping of advance of the yarn following a detection of a yarn breakage condition has required the connection of a mechanical brake to the drives for the draw-off rollers and distributing cylinders. The necessity of providing such additional components has proved to be a space-consuming and costly expedient.

SUMMARY OF THE INVENTION

In accordance with the invention, an improved technique for providing the required braking of the advancing yarn between the detection of a yarn breakage condition and the onset of the "spinning-in" mode has been developed without the necessity of employing the disadvantageous mechanical brakes of the prior art. Illustratively, an adjustable-interval control pulse generator is associated with the output indication outpulsed from the yarn braking sensing means. The variable-duration control pulse is applied to a suitable controllable switch that moves a reversing clutch from a normal position (in which the draw-off rollers and traversing cylinder are rotated in a forward-advance direction) to an operated condition (in which such components are rotated in the reverse direction) during the time that the control pulse is applied to such switch.

The control pulse is initiated immediately upon the generation of the yarn breakage control indication, and is adjusted to last for a duration sufficient to dynamically brake the advancing yarn to a stop as a result of the now-reversed motion of the associated rollers and cylinder. The braking interval is suitably adjusted so that the yarn comes to a stop prior to the exit of the broken end from the withdrawal cylinder. In addition, the control pulse is terminated prior to the initiation of the spinning-in mode, which is accomplished with the use of the same clutch-reversal facilities, so that the expense of providing an additional braking sub-assembly to the spinning machine is completely avoided.

BRIEF DESCRIPTION OF THE DRAWING

The invention is further set forth in the following detailed description taken in conjunction with the appended drawing, in which:

FIG. 1 is a schematic representation of the yarn-withdrawal section of an open-end spinning machine, together with facilities in accordance with the invention for dynamically braking the advance of a withdrawn spun yarn upon the occurrence of a yarn breakage condition;

FIG. 2 is a schematic representation of a portion of the arrangement of FIG. 1, wherein a reversing clutch which is actuated to initiate the dynamic braking operation is shown switched into its operated condition; and FIG. 3 is a set of timing diagrams illustrating the relation between the occurrence of a yarn breakage indication and the generation of a clutch-reversing control pulse suitable for use in the arrangement of FIG. 1.

DETAILED DESCRIPTION

Referring now to the drawing, FIG. 1 depicts a yarn-with-drawal section of an open-end spinning machine. The spinning chamber of the machine is represented by a numeral 100. A conventional withdrawal tube 201 communicates with the outlet of the spinning chamber 100, and a conventional pair of draw-off rollers 2 are disposed downstream of the withdrawal tube 201 for withdrawing spun yarn 1 from the spinning chamber 100 through the tube 201.

A conventional distributing roller 3 is supported for rotation and traverse movement downstream of the draw-off rollers 2, and includes a plurality of flutes 3 for receiving the yarn 1 and for laying such yarn in roving form on the periphery of a take-up bobbin 4, which is disposed in frictional driving engagement with the roller 3.

A shaft 202 of the draw-off rollers 2 is coupled via a schematically represented gear pair 9 to a shaft 31 of the distributing cylinder 3. The shaft 31, in turn, is coupled via a link 8 to a reversible clutch 203.

The clutch 203 is movable from a first normal position shown in FIG. 1 to a second operated position shown in FIG. 2 by means of a switching unit 101 for an interval corresponding to the duration of an actuating pulse applied to an exciting input 204 of the switching unit 101.

In the normal position shown in FIG. 1, a left-hand portion 7 of the clutch 203 is in driving engagement with a gear pair 6, 6' of a first drive shaft 5, which is rotatable in one of two opposite angular directions represented by an arrow 206. Such direction represents a forward advance direction for the yarn 1; in particular, with the clutch in its normal position, the drive shaft 5 is coupled via the gear pair 6, 6', the clutch portion 7 and the gear pair 8 to the cylinder shaft 31, which in turn is coupled via gear pair 9 to the shaft 202 of the draw-off rollers 2. Under such condition, the direction of rotation of the shafts 31, 202 will be effective to draw the yarn 1 out of the withdrawal tube 201 and to wrap it as a yarn package around the bobbin 4.

A yarn breakage sensing element 102 is associated with the output of the withdrawal tube 201 for sensing a yarn break upstream of such coupling point. In response to such yarn breakage, the sensor 102 generates an electrical indication on an output line 211, which in the past has been conventionally employed to initiate a "spinning-in" mode of the rollers 2 and the cylinder 3, after a suitable delay determined by a program controller (not shown) associated with the spinning unit.

During the interval between the occurrence of a signal on the line 211 and the delayed initiation of the spinning-in mode (entailing a reversal of the direction of movement of the rollers 2 and the cylinder 3), it is necessary to stop the forward advance of the yarn 1 before the broken end of the yarn has been withdrawn from the withdrawal tube 201. In the past, such function has been accomplished with the use of an associated mechanical brake. In accordance with the invention, the added space and expense attendant on the use of such separate brake is avoided with the use of a dynamic braking technique now to be described.

In particular, the yarn breakage indication on the line 211 is applied to a triggering input 212 of an adjustable-duration control pulse generator 104. The generator 104 responds to the excitation of its triggering input 212 by supplying, at its output, a control pulse whose duration may be adjusted with the use of an associated control pulse duration selector 213.

The output of the generator 104 is applied over a line 214 to the excitation input 204 of the switching unit 101, thereby causing the unit 101 to move the reversible clutch 203 from its normal position illustrated in FIG. 1 to its operated position shown in FIG. 2 for an interval corresponding to the adjusted duration of the control pulse on the line 214. At the conclusion of such control pulse, the switching unit (which may be embodied by a suitable electromagnet and associated circuitry) restores the clutch 203 into its normal position.

In the operated condition of the clutch 203, a right-hand portion 7′ thereof is disposed in driving engagement with a gear pair 11, 11′ which in turn are coupled to a second driveshaft 10. The shaft 10 is driven by suitable means in a direction of an arrow 216, i.e., in a direction opposite to the direction of rotation of the shaft 5.

Under such circumstances, the respective shafts 31 and 202 of the cylinder 3 and the rollers 2 will be driven in the reverse direction, relative to the forward direction of advance of the yarn 1, when the clutch is in its right-hand position. Specifically, the reverse rotation of the shaft 10 is coupled to the shafts 31 and 202 via the gear pair 11, 11′, the right-hand portion 7′ of the clutch 203, and the gear pair 8.

The reversing of the drive of the cylinder 3 and the rollers 2 in response to a yarn breakage indication will cause a dynamic braking of the still-advancing yarn 1. In further accordance with the invention, the duration of the control pulse on the line 214 is chosen to be long enough so that the forward motion of the yarn 1 is halted, that is, it is braked to a complete stop, but short enough to prevent the yarn from being moved in the opposite, reverse direction by the now-reversed rollers 2. Within such limitations, the duration of the control pulse is further selected so that the dynamic braking operation is completed before the now-broken yarn 1 has exited completely from the withdrawal tube 201. This precaution permits an efficient initiation of the "spinning-in" mode of the rollers 2 and the cylinder 3 after a further time delay chosen by the above-mentioned programmer (not shown).

It will be appreciated that the spinning-in mode can be instrumented by the same type of reversal of the clutch 203 as that indicated above for instrumenting the dynamic braking operation, since in each case a reversal of movement of the cylinder 3 and the rollers 2 will take place. Therefore, since the same physical facilities can be employed for instrumenting both the dynamic braking and the spinning-in operation, considerable simplification of the apparatus and cost savings can be realized.

The yarn breakage indication on the line 211 can take the form shown in curve *a* of FIG. 3. In particular, during the normal advance of an unbroken yarn 1, the output of the sensor 102 exhibits a relatively positive voltage represented by a curve 310. Upon detecting a yarn breakage condition, the output of the sensor 102 exhibits a negative-going jump to a curve portion 30.

The voltage transition between the portions 310 and 30 serves as the trigger signal for the generation of the control pulse on the line 214. Such pulse is represented by a curve 226 in the line *b* of FIG. 3. As indicated before, the duration T of the pulse 226 may be selected in accordance with the above criteria with the use of the selector 213.

In the foregoing, an illustrative technique embodying the invention has been described. Many variations and modifications will now occur to those skilled in the art. It is accordingly desired that the scope of the appended claims not be limited to the specific disclosure herein contained.

What is claimed is:

1. In an open-end spinning machine, a spinning chamber, a withdrawal tube extending downstream from the spinning chamber, first reversible draw-off roller means for normally withdrawing spun yarn from the chamber through the withdrawal tube, a take-up bobbin, a reversible yarn-distributing cylinder disposed in driving engagement with the bobbin and situated downstream of the first roller means for winding spun yarn advanced by the first roller means on the bobbin, first and second drive means rotatable in respectively opposite directions for establishing a forward direction of operation of the first roller means and the cylinder, and a reverse, spinning in, direction of operation of the first roller means and the cylinder, respectively, means including reversible clutch means selectively associated with the first and second drive means and coupled to the first roller means and the cylinder, the clutch means being selectively operable in a first, normal position coupling the first drive means to the first roller means and to the cylinder, and a second, operated position coupling the second drive means to the first roller means and the cylinder, respectively, switching means for the clutch, said switching means having an exciting input, means responsive to an actuating signal applied to the exciting input of the switching means for switching the clutch means from its first to its second position during the period of application of the actuating signal to the exciting input of the switching means, detecting means coupled to the output of the withdrawal tube for sensing a yarn breakage upstream thereof, means responsive to the detecting means for generating a control pulse upon the sensing by the detecting means of a yarn breakage, an adjustable pulse duration control means having a triggering input, said pulse duration control means adjusting the duration of the control pulse in response to the application of a signal to its triggering input, means coupled to the output of the detecting means for applying a signal therefrom to the triggering input of the pulse duration control means, and means for applying the thus adjusted control pulse from the output of the control pulse generating means to the exciting input of the switching means for a length of time sufficient to stop the forward movement of the yarn by the roller means and cylinder rotating in the reverse direction but insufficient to cause reverse movement of the broken end of the yarn in the withdrawal tube.

2. In a method of stopping the forward advance of the yarn withdrawal section of an open-end spinning machine upon the occurrence of a yarn breakage condition, the machine comprising, in combination, a spinning chamber, a withdrawal tube extending downstream from the spinning chamber, first reversible draw-off roller means for normally withdrawing spun yarn form the chamber through the withdrawal tube, a take-up bobbin, a reversible yarn-distributing cylinder disposed in driving engagement with the bobbin and situated downstream of the first roller means for winding spun yarn advanced by the first roller means on the bobbin, first and second drive means rotatable in respectively opposite directions for establishing a forward direction of operation of the first roller means and the cylinder, and a reverse, spinning in, direction of operation of the first roller means and the cylinder, respectively, means including reversible clutch means selectively associated with the first and second drive means and coupled to the first roller means and the cylinder, the clutch means being selectively operable in a first, normal position coupling the first drive means to the first roller means and to the cylinder and a second, operated position coupling the second drive means to the first roller means and the cylinder, respectively, switching means for the clutch, said switching means having an exciting input, means responsive to an actuating signal applied to the exciting input of the switching means for switching the clutch means from its first to its second position during the period of application of the actuating signal to the exciting input of the switching means, detecting means coupled to the output of the withdrawal tube for sensing a yarn breakage upstream thereof, means responsive to the detecting means for generating a control pulse upon the sensing by the detecting means of a yarn breakage, an adjustable pulse duration control means having a triggering input, said pulse duration control means adjusting the duration of the control pulse in response to the application of a signal to its triggering input, means coupled to the output of the detecting means for applying a signal therefrom to the triggering input of the pulse duration control means, and means for applying the thus adjusted control pulse from the output of the control pulse generating means to the exciting input of the switching means, the improvement which comprises the steps of applying the actuating signal to the switching means for an interval sufficiently long to reverse the direction of rotation of the first roller means and the cylinder but only long enough to dynamically brake the forward motion of the advancing yarn to a stop while the broken end of the yarn remains in the withdrawal tube without any reverse movement of of the yarn in the withdrawal tube and thereafter spinning-in the yarn and initiating the forward direction of operation of said first roller means and the cylinder.

* * * * *